US007081596B2

(12) United States Patent
Schneider et al.

(10) Patent No.: US 7,081,596 B2
(45) Date of Patent: Jul. 25, 2006

(54) ARC-QUENCHING DEVICE FOR CIRCUIT BREAKERS HAVING DOUBLE-BREAK CONTACTS

(75) Inventors: Gerhard Schneider, Blumberg (DE); Siegfried Mayer, Gottmadingen (DE); Norbert Papok, Lottstetten (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 11/007,213

(22) Filed: Dec. 9, 2004

(65) Prior Publication Data

US 2005/0150870 A1 Jul. 14, 2005

(30) Foreign Application Priority Data

Dec. 22, 2003 (EP) ..... 03405921

(51) Int. Cl.
*H01H 9/44* (2006.01)

(52) U.S. Cl. ..... 218/22; 335/16; 218/147; 218/156

(58) Field of Classification Search ..... 335/16, 335/147, 195, 201; 218/22, 24, 26, 34, 40
See application file for complete search history.

(56) References Cited

U.S. PATENT DOCUMENTS 4,656,446 A * 4/1987 Chien et al. ..... 335/201
4,743,720 A * 5/1988 Takeuchi et al. ..... 218/24
4,810,841 A * 3/1989 Wolf ..... 218/22
5,122,625 A * 6/1992 Kobayashi et al. ..... 218/1
5,694,098 A * 12/1997 Mody et al. ..... 335/16

FOREIGN PATENT DOCUMENTS

EP 0 255 016 2/1988
EP 0 649 155 A1 4/1995

* cited by examiner

*Primary Examiner*—Lincoln Donovan
(74) *Attorney, Agent, or Firm*—Buchanan Ingersoll PC

(57) ABSTRACT

The present invention relates to an arc-quenching device for circuit breakers having double-break contacts for use in low-voltage distribution systems. Provided around a prechamber (41) is a magnetic shield (91) for the purpose of intensifying the magnetic blowing action on an arc formed between the arc guide rails (51, 61) of the prechamber. In addition, a blowing loop (81) is inserted in the arc-quenching circuit and extends in sections parallel to an arc guide rail (61). Prechamber insulation having a bulge constricting the arc area likewise serves the purpose of optimizing the arc run.

10 Claims, 2 Drawing Sheets

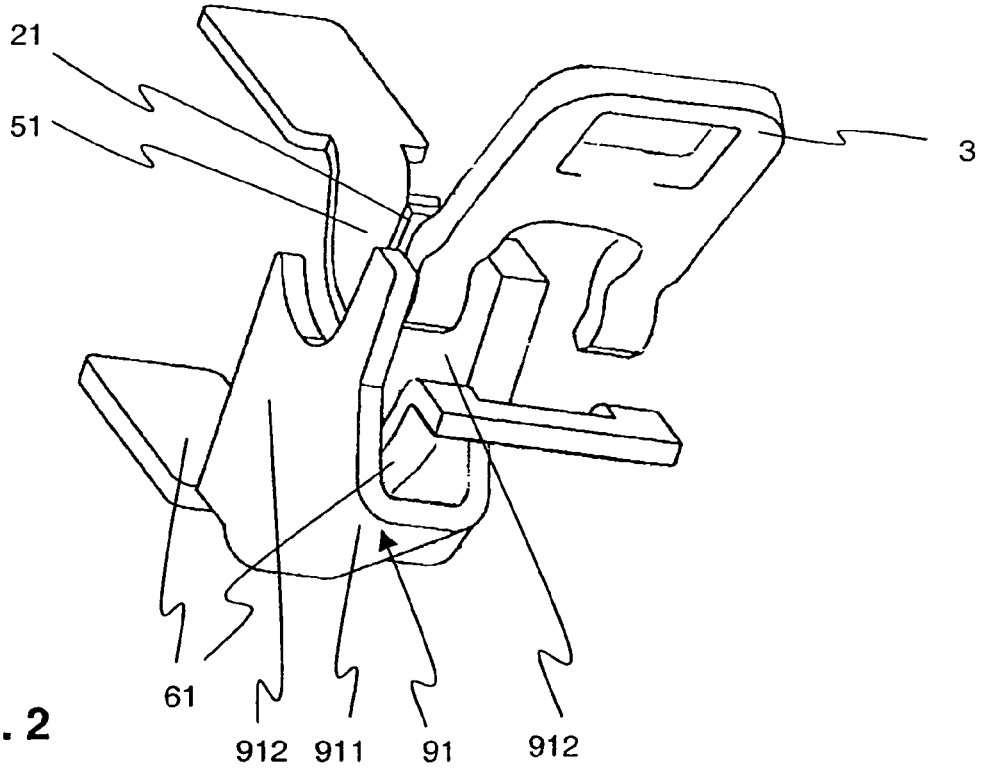
Fig. 2
Fig. 3
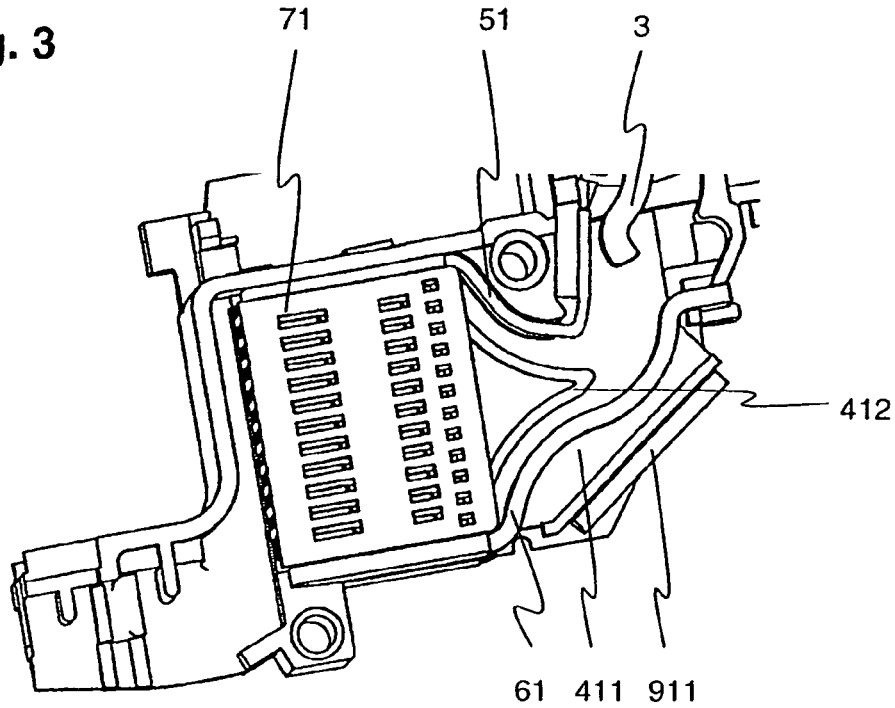

ARC-QUENCHING DEVICE FOR CIRCUIT BREAKERS HAVING DOUBLE-BREAK CONTACTS

TECHNICAL FIELD

The present invention relates to the field of power breakers for low-voltage distribution systems. It relates to an arc-quenching or arc-extinguishing device for circuit breakers having double-break contacts according to the preamble of patent claim 1.

PRIOR ART

In low-voltage distribution systems, installation flush-mounted switches provide rapid and reliable protection of lines, motors, apparatuses and systems subjected to a low voltage from the consequences of an overload and short-circuit currents. They generally have a thermal release having a bimetallic strip and an electromagnetic release having a coil and an impact armature as well as, preferably, a contact arrangement having double-break contacts.

In the case of switching devices of this type, it is of critical importance for the life and the switching power that the arc produced when the contacts are opened does not remain on the contact pieces but is guided as quickly as possible to a quenching chamber region where the arc is cooled and quenched. Every time the arc remains on the contact pieces, even in the millisecond range, the wear and erosion of the contact pieces is increased.

A normal circuit breaker has a contact point which is formed from a fixed and a moveable contact piece. The contact point is located in a so-called prechamber, to which a quenching chamber having an arc splitter stack is connected. The base points of the arc are guided from the fixed contact piece and the moveable contact piece via arc guide rails to the arc splitter stack. In this case, the arc broadens directly after contact opening, and the speed at which the arc runs into the arc splitter stack is dependent on the so-called self-blowing, i.e. the magnetic blowing field induced by the arc itself, the pressure ratios in the arc, the formation of the guide rails and the selection of the contact material.

EP-A 649 155 discloses a generic circuit breaker having double-break contacts, in which an additional electromagnetic blowing loop is provided in the arc-quenching circuit for the purpose of accelerating the arc run. This blowing loop, through which current flows only during the disconnection process, is symmetrical to a partition wall which separates two quenching chambers and is formed geometrically parallel to the arc guide rails. Owing to a parallel flow of current in the blowing loop and the adjacent guide rails, the electromagnetic force on the arc is increased and its movement is accelerated, which ultimately results in a higher switching power.

EP-A 0 212 661 discloses a current limiter for medium- or high-voltage applications, in which an arc drifts from a switching point between two arc guide rails. Owing to the special design of the low-inductance guide rails, the resistance in the quenching circuit is significantly increased, with the result that the quenching circuit can be interrupted easily by an isolator connected in series. For the purpose of accelerating the arc movement, the magnetic field induced by the disconnection current itself is increased by a magnetic core being applied around one of the guide rails.

SUMMARY OF THE INVENTION

The object of the present invention is, in the case of a circuit breaker having double-break contacts, to optimize in a targeted manner the acceleration of the two arcs produced by a disconnection movement of a switching contact. This object is achieved by an arc-quenching device having the features of patent claim 1 and a circuit breaker having the features of patent claim 10. Advantageous embodiments are described in the dependent patent claims.

The essence of the invention is to use a suitable magnetic shield to intensify the magnetic fields in the region of the arc and thus the Lorentz force acting on the arc and driving said arc in the direction of the arc splitter stacks. This causes the arc to move more rapidly, the contact wear to be reduced and the disconnection power to ultimately be increased. Owing to the separate magnetic shield according to the invention, the arc guide rails themselves no longer need any magnetic properties and can, as a result, be produced from non-magnetic copper favoring arc movement.

The magnetic shield produced, for example, from steel is preferably realized by an integral shaped part, which is open at one end and has a U profile, being turned over a link-side arc guide rail, such that the arc area or the prechamber is sealed off on three sides by the shaped part. The magnetic field, acting on the arc, of the disconnection current flowing in the arc guide rail, i.e. the so-called self-blowing, is thus intensified. In addition, such a shaped part can be produced easily and can be placed on the arc guide rail during the assembly process.

In one preferred embodiment of the invention, a blowing loop is introduced in an arc-quenching circuit, through which current flows only during the disconnection process of the circuit breaker and which comprises the two arcs. Said blowing loop is arranged in sections parallel to an arc guide rail and has a current flowing through it which points in the same direction as the disconnection current in the adjacent arc guide rail. As a result, the magnetic blowing actions of the two currents are accumulated on the arc. The U-shaped magnetic shield in this case preferably also encloses or surrounds this blowing loop section which is parallel to the guide rail.

The blowing loop is preferably provided in terms of its geometry or material with current-limiting properties. Since the blowing loop does not carry any current during rated operation, i.e. when the switching contact is closed, this does not influence the intrinsic impedance of the switch and, as a result of its low starting or cold resistance of a few mΩ, also does not impede the commutation of the arc to the corresponding arc guide rails. Once commutation of the two arcs has taken place, the blowing loop also has current flowing through it, as a result of which its impedance increases and the disconnection current is limited.

In the case of switches having double-break contacts, the blowing loop is designed such that the two arcs are favored to the same extent, for example owing to a design of the blowing loop which is symmetrical with respect to the quenching chamber partition wall or owing to two blowing loops which are connected electrically in parallel and are each associated with one arc. In any event, each arc or the two prechambers has/have a dedicated magnetic shield which at the same time magnetically shields the arc area with respect to the magnetic fields prevailing in the other arc area.

In one preferred embodiment, the U-shaped magnetic shield is separated from the actual arc area by means of prechamber insulation made of, for example, Plexiglass.

This prevents flashover of the arc to the possibly metallic shield. In addition, the insulation may have outgasing properties, i.e. may separate out arc-quenching gases.

The prechamber insulation preferably has a bulge protruding into the arc region for the purpose of reducing the prechamber volume. The reduced volume counteracts a pressure loss of the gases in the arc region and prevents the arc from expanding. In particular, the base points of the arc remain compact and thus heat the arc guide rails, which is necessary for movement of the arc.

The bulge preferably has a V-shaped profile, which opens in the direction of the quenching chamber and approximately follows the contour of the guide rails. This ensures that the two arc base points move at the same speed and that the arc is extended over its maximum length, predetermined by the spacing between the arc guide rails, prior to running into the quenching chamber. All of the arc splitter plates therefore contribute to the same extent to dividing and quenching the arc.

BRIEF DESCRIPTION OF THE FIGURES

The invention will be explained in more detail below with reference to exemplary embodiments in connection with the drawings, in which:

FIG. 2 shows a perspective illustration of a detailed view of a first prechamber, and FIG. 3 shows a perspective illustration of a section through a first prechamber having prechamber insulation.

The reference numerals used in the drawings are summarized in the list of reference numerals. In principle, the same parts are provided with the same reference numerals.

WAYS OF IMPLEMENTING THE INVENTION

Figure 1:
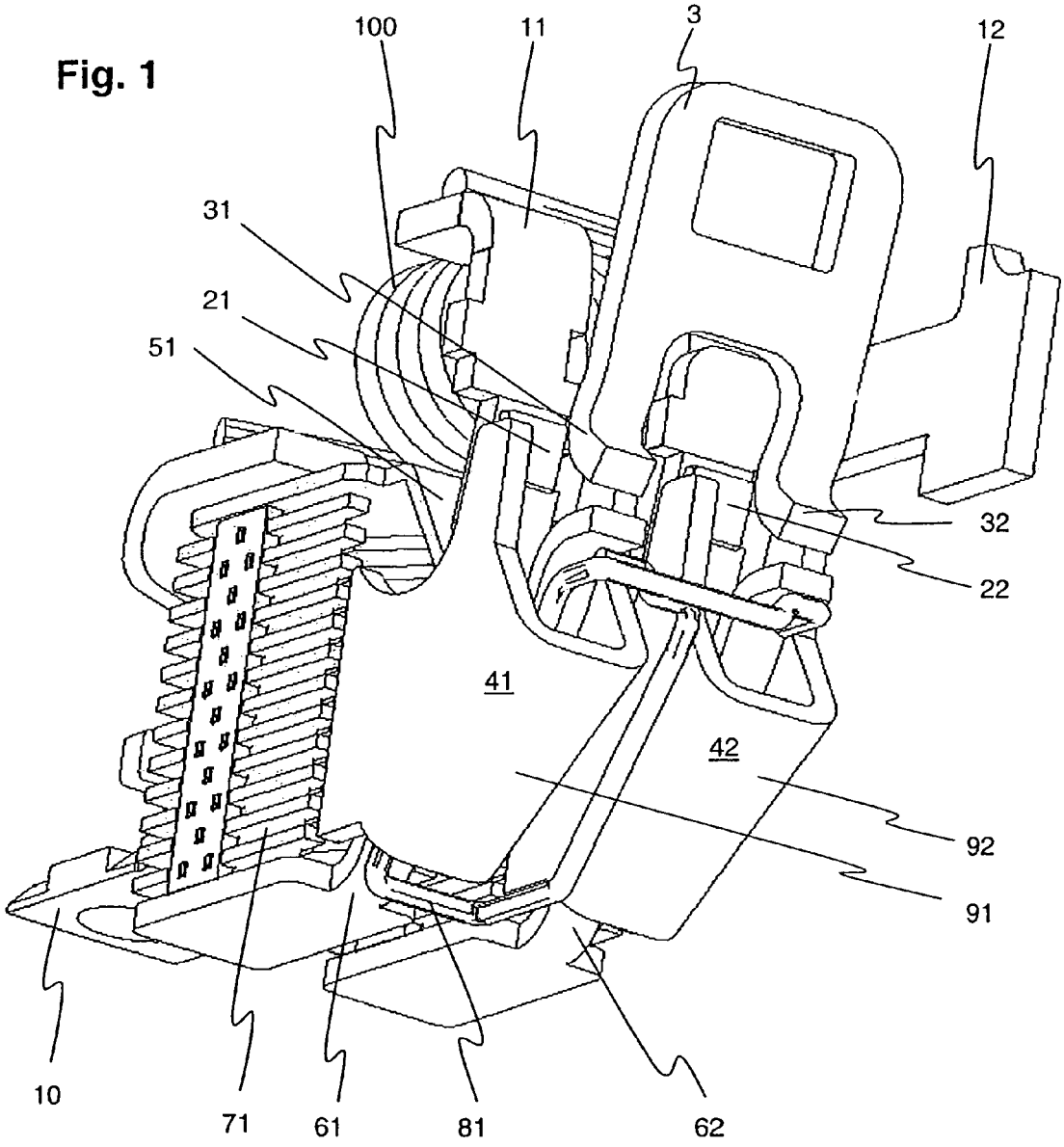
FIG. 1 shows a perspective illustration of an arc-quenching device comprising two prechambers, each having a magnetic shield and a blowing loop.

FIG. 1 shows a view at an angle from below of a detail of a single- or multipole circuit breaker having two switching contacts, connected in series, per pole. A first connection terminal 10 is connected, via the coil of a short-circuit current release 100 and a first connecting conductor 11, to a first fixed contact 21. In the closed position of the switch (not shown) this first fixed contact 21 is in electrical contact with a first link contact 31 of a moveable, fork-shaped contact link 3. In the closed position of the switch, a second link contact 32 of the contact link 3 is in contact with a second fixed contact 22 which is also connected, via a second connecting conductor 12, to an overcurrent release (not shown) and to a second connection terminal. The two switching points formed by in each case a fixed and a link contact each have an associated first or second prechamber 41, 42 respectively.

If, in the event of a short circuit or an overcurrent, the contact link 3 is moved away from the fixed contacts 21, 22 by means of the short-circuit current release 10 or the overcurrent release, two arcs are formed between the fixed contacts 21, 22 and the link contacts 31, 32, said arcs having the disconnection current flowing through them in opposing directions and the link-side base points of said arcs commutating or "springing" to link-side arc guide rails 61, 62 as a result of the link contacts 31, 32. With the favorable shape of the (in the arrangement shown in FIG. 2 "lower") link-side arc guide rails 61, 62 and the (in the arrangement shown in FIG. 1 "upper") connection-side arc guide rails 51, 52, which are connected to the fixed contacts 21, 22, a first arc creeps between the first connection-side arc guide rail 51 and the first link-side arc guide rail 61 in the direction of a first arc splitter stack 71, whereas a second arc moves toward a second arc splitter stack 72 between the second connection-side arc guide rail 52 and the second link-side arc guide rail 62. On disconnection, the arcs are thus forced along the arc guide rails in quenching chambers owing to the self-induced magnetic fields, are cooled on the arc splitter plates, divided up into arc elements and quenched.

FIG. 2 shows another perspective view of a detail of the first prechamber 41, the arc splitter stack between the expanded ends of the two first arc guide rails 51, 61 having been omitted. The magnetic shield 91 according to the invention having a U-shaped cross section which is produced from a magnetically effective material such as, for example, iron or steel, preferably in the form of an integral shielding plate, is arranged such that it closes off the arc area at the sides, said arc area being defined between the first arc guide rails 51, 61. A rear side 911 of the shield is located along the first link-side arc guide rail 61, whereas the side faces 912 of the shield extend in the direction of the first connection-side arc guide rail 51. The magnetic shield 91 focuses the arc magnetic field and, in addition, drives the arc in the direction of the quenching chambers.

As can further be seen in FIG. 1, each of the two prechambers 41, 42 has an associated separate magnetic shield 91, 92. As a result, the arc region between the two arc guide rails 51, 61; 52, 62 is magnetically shielded with respect to the exterior and, in particular, with respect to the other prechamber 42; 41. Also envisaged in FIG. 1 between the first link-side guide rail 61 and the second link-side guide rail 62 is a first blowing loop 81. In the event of tripping, the disconnection current flows from the first to the second arc through this first blowing loop 81. It envelops at least one Lorentz section, which lies within the shield 91, is arranged geometrically parallel to the first link-side arc guide rail 61, and in which the direction of current flow is the same as in the adjacent arc guide rail 61. As a result, the electromagnetic Lorentz force on the first arc is increased and moves said first arc in the direction of the first arc splitter stack 71.

The blowing loop 81 is preferably given disconnection current-limiting properties. A current-limiting behavior may be achieved, for example, by the selection of the material. For this purpose, all of the conductors having an electrical resistance which increases as the current level increases are suitable, these including, in particular, the metallic alloys, which are known as PTC (positive temperature coefficient) resistors, based on Ni, Co, Fe, such as NiCr, NiMn, NiFe, NiCrMn, NiCo, NiCoFe, CoFe, CrAlFe, or ceramic materials. A further PTC resistor such as this is based on a polymer composite, having a polymer matrix filled with a mixture of carbon, a metal such as Ni, for example, and a boride, silicide, oxide or carbide such as $TiC_2$, $TiB_2$, $MoSi_2$, $V_2O_3$, for example. It is essential here that the starting or cold resistance is not too high and that the commutation of the arcs to the link-side guide rails 61, 62 and the formation of the arc-quenching circuit associated therewith are not impeded.

FIG. 3 shows a section through the first prechamber 41, as a result of which only the section face of the rear side 911 of the first magnetic shield 91 is visible. In general, the arc guiding properties are highly dependent on the contour of the arc guide rails 51, 61. Owing to the constriction which is apparent between the upper and lower guide rail over a large proportion of the prechamber, the arc is accelerated in optimum fashion. Since, when the guide rails 51, 61 expand, the magnetic pulling action by the arc splitter plates 71 made of magnetic material is already effective, the arc is prevented from remaining on the arc guide rails and it is possible for said arc to run in without any delay.

Located between the guide rails 51, 61 and the magnetic shield 91 is prechamber insulation 411 which essentially has the same cross section as the shield 91 and insulates said shield 91 from the arc region. Prechamber insulation in the form of an injection-molded part is inserted in the shield in a suitable manner before said shield is assembled or is turned over the guide rails. A bulge 412 within the prechamber insulation conducts the ionized gases to the guide rails which are heated by the gases and thus allows the arc base point to run. The bulge 412 reduces the spacing perpendicular to the sectional plane in FIG. 3 between the side faces of the insulation, i.e. the clear gap in the arc area, by 30 to 50%. The bulge as shown in FIG. 3 has the form of an elongate elevation, which opens in the manner of a V in the direction of the arc splitter stacks 71.

LIST OF REFERENCE NUMERALS

| | |
|---|---|
| 10 | First connection terminal |
| 100 | Short-circuit current release |
| 11 | First connecting conductor |
| 12 | Second connecting conductor |
| 21 | First fixed contact |
| 22 | Second fixed contact |
| 3 | Contact link |
| 31 | First link contact |
| 32 | Second link contact |
| 41 | First prechamber |
| 411 | Prechamber insulation |
| 412 | Bulge |
| 42 | Second prechamber |
| 51 | First connection-side arc guide rail |
| 52 | Second connection-side arc guide rail |
| 61 | First link-side arc guide rail |
| 62 | Second link-side arc guide rail |
| 71, 72 | Arc splitter stacks |
| 81 | First blowing loop |
| 82 | Second blowing loop |
| 91 | First magnetic shield |
| 911 | Rear side |
| 912 | Side face |
| 92 | Second magnetic shield |

The invention claimed is:

1. An arc-quenching device for a circuit breaker having double-break contacts, comprising two fixed contacts which are connected to connection terminals of the circuit breaker and which, in a closed position of the switch, are in contact with two link contacts of a moveable contact link, two prechambers, separated by a partition wall, each having two arc guide rails, of which a connection-side arc guide rail is connected to a fixed contact, and a link-side arc guide rail is formed for the purpose of taking over an arc from the contact link, two quenching chambers, connected to the prechambers, each having an arc splitter stack which is connected to the respective arc guide rails, wherein a magnetic shield is provided for the purpose of intensifying the magnetic forces acting on a first arc which is formed between the first link-side and the first connection-side arc guide rails, and wherein the magnetic shield is arranged such that it closes off the arc area at the sides, said arc area being defined between the two arc guide rails.

2. The arc-quenching device as claimed in claim 1, wherein the magnetic shield is an integral shaped part having a rear side and two parallel side faces which form a U-shaped profile, the rear side coming to rest next to the first link-side arc guide rail, and the side faces pointing toward the connection-side arc guide rail.

3. The arc-quenching device as claimed in claim 2, wherein a first blowing loop, which is connected to the two link-side arc guide rails, is provided for the purpose of generating a Lorentz force acting on the first arc and directed toward the first arc splitter stack.

4. The arc-quenching device as claimed in claim 3, wherein the magnetic shield surrounds the first link-side arc guide rail and a Lorentz section, which is arranged geometrically parallel thereto, of the blowing loop.

5. The arc-quenching device as claimed in claim 3, wherein the first blowing loop has current-limiting properties.

6. The arc-quenching device as claimed in claim 3, wherein the two prechambers are shielded from one another by in each case one associated magnetic shield.

7. The arc-quenching device as claimed in claim 2, wherein prechamber insulation made of an electrically non-conductive material surrounds the arc region and insulates the arc with respect to the magnetic shield.

8. The arc-quenching device as claimed in claim 7, wherein a bulge is provided on at least one of the inner walls of the prechamber insulation which face the arc region.

9. The arc-quenching device as claimed in claim 8, wherein the bulge of the prechamber insulation has a V-shaped structure which opens toward the quenching chambers.

10. A circuit breaker having double-break contacts, comprising two connection terminals connected to two fixed contacts via coil-less connecting conductors, a short-circuit current release acting on a contact link and the arc-quenching device as claimed in claim 1.

* * * * *